US005433288A

United States Patent [19]

James

[11] Patent Number: 5,433,288

[45] Date of Patent: Jul. 18, 1995

[54] FIRE FIGHTING HOSE HARNESS

[76] Inventor: Tyrone James, 1443 W. 69th St., Los Angeles, Calif. 90047

[21] Appl. No.: 225,563

[22] Filed: Apr. 11, 1994

[51] Int. Cl.[6] ..... A45E 3/04

[52] U.S. Cl. ..... 182/3; 248/75; 224/250

[58] Field of Search ..... 182/3; 224/208, 202, 224/257, 258, 250; 239/152; 248/75

[56] References Cited

U.S. PATENT DOCUMENTS

| | | | |
|---|---|---|---|
| 1,405,164 | 1/1922 | Schein | 248/75 X |
| 1,766,667 | 6/1930 | Miller | 239/152 X |
| 2,070,762 | 3/1954 | Stivason | 248/75 X |
| 2,692,712 | 10/1954 | Conley | 248/75 |
| 3,263,806 | 8/1966 | Ring | 224/202 X |
| 4,446,997 | 4/1984 | Himberg | 225/257 X |
| 4,762,257 | 8/1988 | Spillers | 224/250 X |
| 4,911,347 | 3/1990 | Wilhite | 224/202 X |

*Primary Examiner*—Alvin C. Chin-Shue
*Attorney, Agent, or Firm*—Charles H. Thomas

[57] ABSTRACT

Improved fire fighting apparatus is provided by equipping a tubular fire fighting hose with a pair of sets of attachment devices located on the hose proximate the nozzle and in longitudinally spaced separation from each other. These attachment devices are preferably padeyes that project radially outwardly from the fire hose. There are four padeyes in each set. The first set is spaced about twelve inches rearwardly from the nozzle, while the second set is spaced about twenty four inches behind the nozzle. A shoulder strap has releasable swivel mounted snap fastener connectors on the ends thereof. The snap fasteners at the strap ends are attached to the upwardly projecting loop of a padeye in each of the sets, so that the shoulder strap can be slung over a fire fighter's shoulder. The harness apparatus preferably includes a waist belt also having swivel mounted releasable snap fasteners at the hips thereof. The waist belt snap fastener at the hip beneath the fire fighter's arm carrying the hose is engaged in another one of the padeye attachment loops in the rear set of attachment devices. The shoulder and waist harness apparatus provide a fire fighter with greatly enhanced control of a fire hose, and allow the fire hose to be operated with maximum effectiveness and minimum fatigue.

9 Claims, 2 Drawing Sheets

FIRE FIGHTING HOSE HARNESS

BACKGROUND OF THE INVENTION

1. Field of the Invention

The present invention relates to an improved fire fighting hose which includes a harness to aid in supporting the hose near the hose nozzle.

2. Description of the Prior Art

Fire fighting hoses have existed for many years. Although advances in the construction of fire hoses have been made over the years insofar as selections of material, nozzle configurations and hose couplings are concerned, the basic structure of a fire fighting hose has remained essentially unchanged. Specifically, a fire fighting hose of the type used by professional fire fighters employs a tough but flexible tubular structure forming the body of the hose. The tubular structure of the hose may be constructed of tough, woven fabric having a rubberized or other water impenetrable inner surface. At one end the body of the fire fighting hose is provided with a standardized metal coupling suitable for attachment to a pumping outlet port in a fire engine. At its opposite end the body of the fire hose has a metal nozzle which directs a stream of water at a blaze to be brought under control.

Conventional fire hoses are preferably constructed so that the body of the hose can be collapsed relatively flat. This permits a hose of relatively great length to be collapsed and stored in a relatively compact area. When the hose is in use, however, and carries a flow of water therethrough, the pressure of the water forms the body of the hose into a cylindrical annular tube-like structure.

To effectively fight fires a fire fighting hose must be constructed to conduct a considerable volume of water at a high rate of flow. As a consequence, fire fighting hoses utilized by professional fire fighters must be constructed of heavy, durable materials which cannot be easily punctured and which will not develop leaks. As a result, professional fire fighting hoses are quite heavy and difficult to manually manipulate when conducting a flow of water therethrough. Indeed, it is not uncommon for two or even more fire fighters to be required to control the awesome power of the hose and effectively direct the nozzle of a hose at the fire to be brought under control.

Due to the tremendous power of the water flowing through a fire hose in combatting a fire, fire fighters do sometimes lose control of a hose even though they normally employ both arms to control the hose and point the nozzle appropriately. Sometimes the power of the water surging through the hose causes a fire fighter to lose his grip on the body of the hose. When this occurs the nozzle end of the hose will sometimes thrash wildly and can only be brought under control by cutting the flow of water to the hose. Such incidents are dangerous to the fire fighters involved, since receipt of an unexpected blast of water from an uncontrolled hose can cause a fire fighter to lose his grip or balance and then fall, often while in a precarious position. Also, the violently moving nozzle itself can have the same effect and also cause serious injury to the fire fighter by delivering powerful blows to the fire fighter's head, hands or body.

Furthermore, due to the noise and commotion that exists in fighting a fire considerable time is expended in communicating the problem of loss of control of a hose to the personnel controlling the flow of water through the hose so that water pressure can be cut to that hose in order to permit the fire fighting personnel to regain control of the hose. Also, valuable time is lost in combatting the fire, since the attention of certain of the fire fighting personnel must be directed toward regaining control of the hose, rather than knocking down the fire.

SUMMARY OF THE INVENTION

The present invention involves an improvement to an otherwise conventional fire hose of the type employed by professional fire fighters. According to the invention the nozzle end of a fire fighting hose is provided with a harness which aids a fire fighter in supporting and controlling the fire hose while fighting a fire. As part of the invention, the fire hose is provided with a plurality of attachment devices projecting radially from the hose near the nozzle end of the hose, but at longitudinally separated locations therealong. The attachment devices may take the form of padeyes set into the structure of the hose and held in place by reinforcing bands.

Preferably the padeyes are arranged in two sets located at longitudinally spaced intervals near the hose nozzle. A first set of attachment devices is located preferably between about six and eighteen inches from the base of the nozzle. The second set of attachment devices is slightly more remote from the nozzle and is located behind the first set. Typically the second set of attachment devices is located between about twenty four and thirty six inches from the base of the nozzle.

The attachment devices of the improved fire hose of the invention allow a harness to be attached to the hose. At the very minimum the harness involves the provision of a shoulder strap having couplings at both ends. The couplings are adapted for connection to the attachment devices that project radially from the structure of the hose. One end of the shoulder strap is connected to one of the attachment devices in the first set next to the hose nozzle, while the other end of the strap is connected to one of the attachment devices in the second or rear set. Preferably, releasable connectors, such as snaps mounted on swivels are employed at the opposite ends of the shoulder strap so that the shoulder strap can be releasably coupled to the radially projecting attachment devices on the hose at longitudinally separated intervals therealong.

When the connectors are snapped onto the attachment devices, the shoulder strap forms a sling and can pass over the shoulder of a fire fighter. The ends of the strap are secured to the hose both forward and rearward of the fire fighter's body. The fire fighter can thereby sling the shoulder strap over the shoulder of one arm and grip the hose under the same arm. The shoulder strap serves to bear a good portion of the weight of the water loaded hose, as well as the forces of the water passing through the hose. This weight and the forces involved need not be carried solely by the fire fighter's arm muscles, but are borne by the fire fighter's much stronger back and leg muscles.

By employing the harness apparatus of the invention, a fire fighter is able to more effectively control and manipulate a fire fighting hose than is possible by merely gripping the hose with the arms. Preferably the harness apparatus is not limited to merely a shoulder strap. To the contrary, it is advisable to employ a belt about the waist of the wearer as well.

The ends of the waist belt are each preferably equipped with a quick disconnect fastening mechanism of the type utilized in automotive seatbelts. A plurality of connectors are spaced from the ends of the belt. These connectors are also coupled to the attachment devices projecting radially from the hose. The connectors on the waist belt of the harness are located at the hips of the wearer and are preferably also snaps fasteners mounted on swivel couplings. Thus, in addition to the connection of the hose to the shoulder strap by the shoulder strap fasteners, the waist belt fasteners also connect the hose to the hip of the fire fighter. This connection allows the fire fighter to twist and manipulate the hose to advantage using the stronger abdominal, chest and back muscles, rather than only the more limited strength of the arm muscles.

In one broad aspect the present invention may be considered to be, in combination, a tubular fire hose having a nozzle at one end thereof and a plurality of longitudinally spaced attachment devices projecting radially outwardly therefrom proximate the nozzle, and a shoulder strap attached to ones of the longitudinally spaced attachment devices to form a shoulder sling for assistance in supporting the hose. In the preferred embodiment the attachment devices are formed as loops projecting outwardly from transverse pads embedded in the structure of the hose. Preferably also the attachment devices are arranged in sets longitudinally spaced from each other proximate the nozzle of the hose. Each of these sets preferably includes a plurality of attachment devices spaced from each other circumferentially about the hose. For example, each set may be formed of four attachment devices spaced ninety degrees apart about the circumference of the hose.

In a preferred construction releasable snaps are mounted on both ends of the shoulder strap for releasably engaging the loops projecting radially from the hose. The releasable snaps are mounted on the ends of the shoulder strap by swivel connectors.

In the preferred combination the invention is also comprised of a waist belt having opposite ends attachable to each other and releasable snaps mounted on the waist belt at spaced intervals from both of the opposite ends. In this way the releasable snaps of the waist belt reside proximate the hips of a wearer and are releasably connectable to at least one of the attachment devices projecting radially from the hose. The releasable snaps of the waist belt are also preferably mounted on the waist belt by means of swivel connectors.

Preferably the combination of the invention also provides a reinforcing band disposed coaxially about the fire hose in longitudinal alignment with each of the sets of attachment devices. The reinforcing bands circumferentially reinforce the hose and entrap the pads of the padeye devices therewithin. Longitudinal slots may be formed through the bands to accommodate the loops which project radially outwardly through the reinforcing bands. The loops are thereby accessible for engagement by the releasable snaps.

In another broad aspect the invention may be defined as an improvement in a fire hose having a flexible tube with a nozzle at one end thereof. The improvement of the invention is comprised of a plurality of attachment devices projecting radially from the flexible tube proximate the nozzle and at longitudinally separated locations along the flexible tube, and a shoulder strap having opposite ends. Each of the shoulder strap ends is connected to a different one of the attachment devices at the longitudinally separated locations.

In still another broad aspect the invention may be considered to be the combination of a tubular fire fighting hose having a nozzle at one end thereof, a pair of sets of attachment means located on the hose proximate the nozzle and in longitudinally spaced separation from each other, and a shoulder strap. Each of the attachment means projects radially outwardly from the hose. The shoulder strap has opposite ends, each of which is coupled to an attachment means in a different one of the sets of attachment means.

The invention may be described with greater clarity and particularity by reference to the accompanying drawings.

DESCRIPTION OF THE EMBODIMENT

Figure 1:
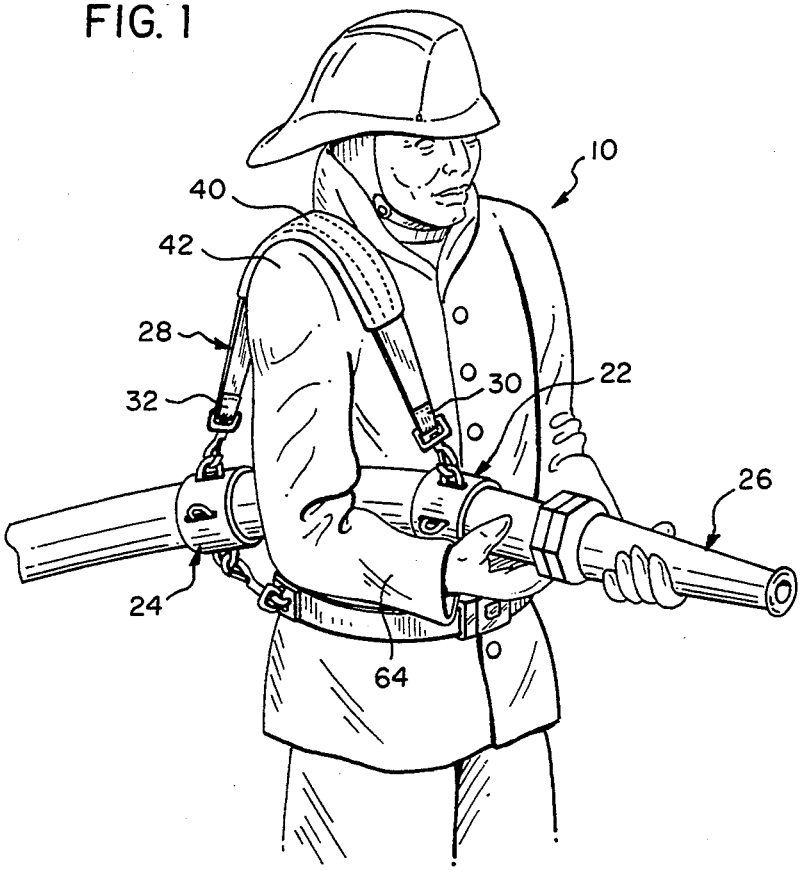
FIG. 1 illustrates a fire fighter utilizing a fire hose equipped with the harness of the invention.

FIG. 1 illustrates a fire fighter 10 employing a fire hose 12 improved according to the invention. The fire hose 12 is equipped with attachment devices in the form of padeyes 14 formed of pads 16 and loops 18, shown in detail in FIGS. 3 and 4. The loops 18 of the padeyes 14 project radially from the tubular body of the hose 12 through slots 20 defined in reinforcing bands 22 and 24 positioned at locations longitudinally separated from each other along the hose 12 proximate the nozzle 26 thereof. The improved fire hose 12 is also equipped with a shoulder strap 28, the ends 30 and 32 of which are each connected to a different one of the attachment devices 14 at each of the longitudinally separated locations of the bands 22 and 24.

The hose 12 is of the type employed by professional fire fighters. Hoses of this type have an inside diameter of one and one half inches, one and three quarter inches, two inches, two and one half inches, three inches, four inches or five inches. Such hoses are capable of carrying a huge volume of water for maximum effectiveness in knocking down and putting out a fire. However, because of the high volume of water which it carries, the hose 12 is difficult to control and effectively direct the nozzle 26 at a fire in a accurate manner.

Figure 3:
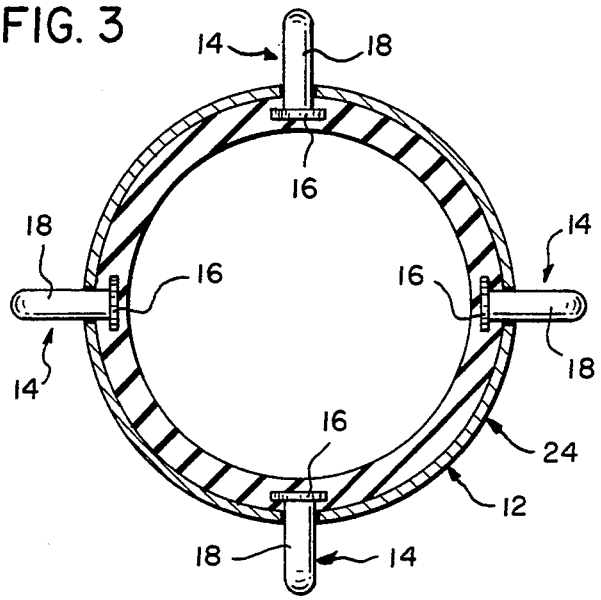
FIG. 3 is a cross sectional elevational detail illustrating the attachment devices in the improved fire hose of the invention.
Figure 4:
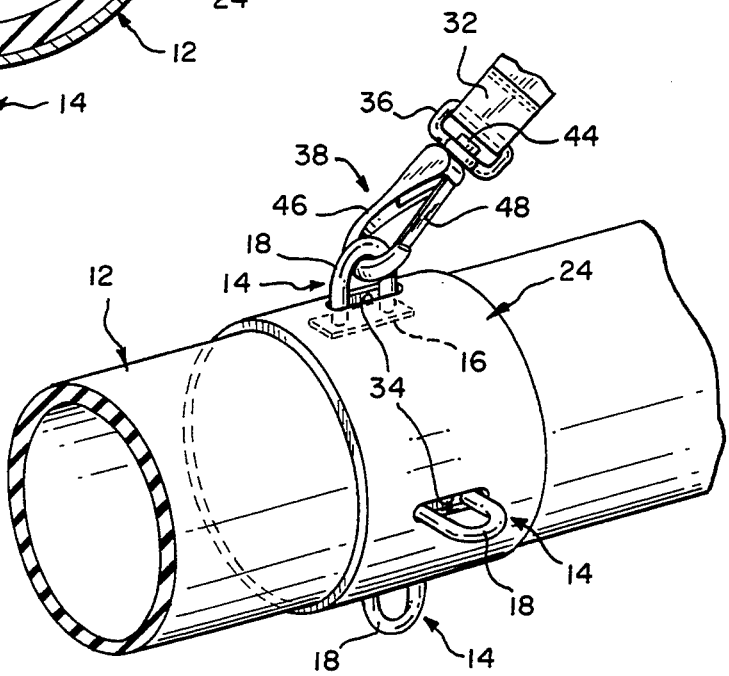
FIG. 4 is a perspective detail illustrating the interconnection of the releasable connectors to the attachment devices shown in FIG. 3.

The structure of the flexible tube forming the improved hose 12 according to the invention is best depicted in FIGS. 3 and 4. As shown in those drawing figures the pads 16 of the padeyes 14 are actually imbedded in the structure of the hose 12 during the initial fabrication of the hose.

The reinforcing bands 22 and 24 are constructed of aluminum and are each about four inches in length. The bands 22 and 24 are identical in construction and in interaction with the padeyes 14 and with the fire hose 12. Only the band 24 is illustrated in FIG. 4, but the connection and operation of the band 22 is identical to that depicted in FIG. 4.

The aluminum bands 22 and 24 have a wall thickness of about three eighths of an inch and extend about the tubular structure of the hose 12 in intimate contact therewith at each of the two longitudinally separated locations. The center of the band 22 is about twelve inches from the base of the nozzle 26, while the center of the band 24 is located about thirty inches therefrom. The bands 22 and 24 each have narrow interior slots 34 defined through their walls. The slots 34 extend in a longitudinal direction relative to the length of the hose 12 and are narrow enough so that the pads 16 extend laterally beyond the slots 34. In this way the bands 22 and 24 entrap the pads 16 of the padeyes 14 within their radial confines. The loops 18 of the padeyes 14 project radially outwardly through the slots 34 in the bands 22 and 24, where they are accessible for engagement. The loops 18 of the padeyes 14 preferably form engageable openings of a generally semi-circular configuration having a diameter of about one to one and one half inches. The padeyes 14 are preferably formed of stainless steel. Consequently, they will not rust, despite heavy exposure to water, but are quite strong as well.

Figure 2:
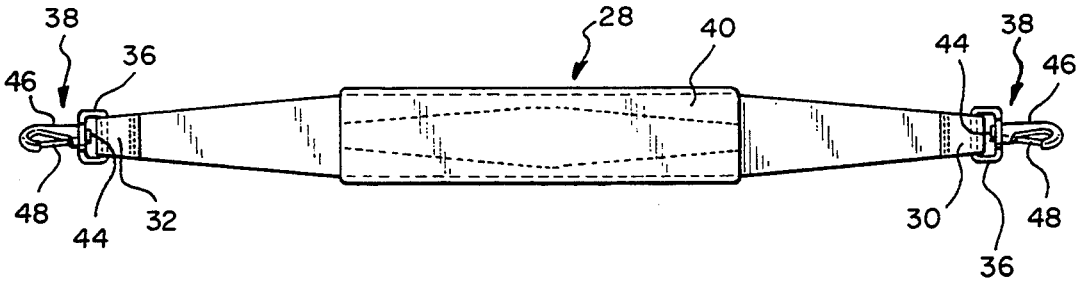
FIG. 2 is an isolated plan view of the shoulder strap employed in the embodiment depicted in FIG. 1.

The shoulder strap 28 is depicted in isolation in FIG. 2. The shoulder strap 28 is an elongated structure formed of a rugged, canvas material having a greatest breadth at its center and is narrowest at its ends 32 and 34. Preferably, the shoulder strap 28 also has a cushioning pad 40 located in the central region between the ends 30 and 32. The cushion pad 40 is formed as a sleeve about the body of the strap 28 and is sewn thereto so as to more evenly distribute the weight of the hose 12 on the shoulder 42 of the fire fighter 10. This reduces the fatigue and discomfort which the fire fighter 10 is likely to experience utilizing the device of the invention. The ends 30 and 32 of the shoulder strap 28 are directed through metal loops or strap eyes 36 of releasable fasteners 38. The fabric ends 30 and 32 of the strap 28 are doubled over and securely sewn so that the releasable fasteners 38 are permanently attached thereto.

The padeyes 14 are arranged in separate sets and are immobilized by the reinforcing bands 22 and 24 at each of the longitudinally separated locations indicated in FIG. 1. Each set of padeyes 14 is comprised of four individual padeyes 14 circumferentially spaced from each other within the confines of the reinforcing bands 22 and 24 at ninety degree intervals. In this way the loop 18 of a different padeye 14 extends upwardly, downwardly, and to both sides in each of the sets of padeyes 14 at circumferentially spaced intervals about the fire fighting hose 12.

The releasable connectors 38 of the opposite ends 30 and 32 of the shoulder strap 28 are preferably swiveling, round eye spring snaps. The spring snaps 38 each include a snap element which has a rigid hook 46 and a resilient leafspring keeper 48 joined together at their bases. The snap elements are mounted to D-ring or square ring strap eyes 36 by means of swivels indicated at 44 in FIG. 2. The spring snaps 38 serve as releasable connectors on each of the ends 30 and 32 of the shoulder strap 28 that are quire suitable for releasable coupling to the padeyes 14. That is, the hook elements 46 of the releasable snaps 38 are engageable through the loops 18 of the padeyes 14, and the leafspring keepers 48 ensure that the snap elements 38 remain fully engaged with the padeyes 14 until purposefully disengaged.

Figure 5:
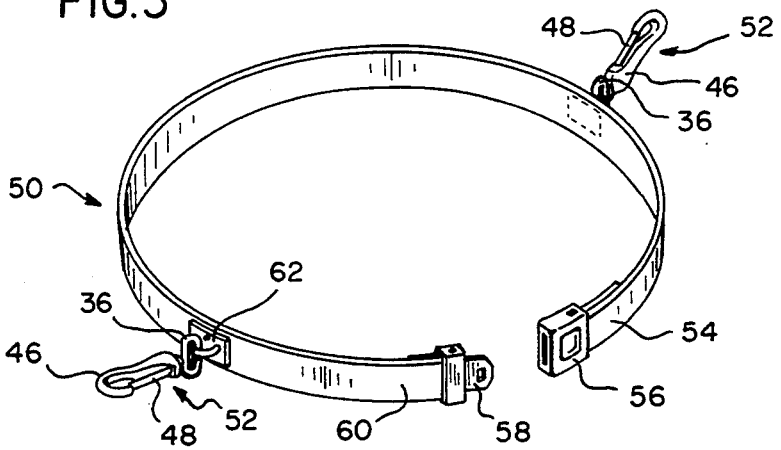
FIG. 5 is a perspective view of a waist belt employed in the embodiment of FIG. 1, shown in isolation.

As shown in FIGS. 1 and 5, the harness apparatus of the invention also includes a waist belt 50 having releasable connectors 52 thereon. The waist belt 50 is formed of a heavy duty, canvas material, typically between about thirty four and forty four inches in length. The end 54 of the waist belt 50 terminates at a lift flap metal buckle 56 that has an opening therein designed to receive an apertured tongue 58 mounted at the other end 60 of the waist belt 50. The buckle 56 and the tongue element 58 both include conventional length adjustment mechanisms so as to vary the overall length of the waist belt 50 from either end. The buckle 56 engages the tongue 58 in a releasably attachable manner with an operating mechanism like that employed in automotive vehicle and aircraft safety belts.

The waist belt 50 also includes a pair of releasable snaps 52 which are mounted on the belt 50 in spaced separation from the ends 54 and 60 thereof. The releasable snaps 52 are identical to the releasable snaps 38 in construction and are secured to the belt 50 by means of padeyes 62. The bases or pads of the padeyes 62 are securely riveted to the structure of the belt 50 at locations approximately eight to twelve inches from the buckle 56 and tongue 58. The releasable snaps 52 are likewise mounted on the padeyes 62 by swivels 44 just like the releasable snaps 38 shown in FIGS. 2 and 4.

To utilize the improved combination of the invention, the fire fighter 10 first puts on the waist belt 50 and adjusts the length of the belt 50 to his waist size by utilizing the adjustment mechanisms at the ends 54 and 60 thereof. The fire fighter adjusts the waist belt 50 so that the releasable snaps 52 are properly positioned, one on each hip as shown in FIG. 1.

When the hose 12 is to be utilized, the fire fighter 10 takes the shoulder strap 28 and secures the end 30 thereof to the loop 18 of the padeye 14 projecting upwardly through the reinforcing band 22 that is located closest to the nozzle 26. The fire fighter 10 then attaches the other snap fastener 38 at the other end 32 of the shoulder strap 28 to the upwardly projecting loop 18 of the padeye 14 that extends upwardly and passes radially outwardly through the rear reinforcing band 24. The fire fighter 10 then inserts one arm 64 underneath the strap 28, between the strap 28 and the hose 12, and hoists the strap 28 up onto one shoulder 42 so that the weight of the fire fighting hose 12 is distributed across his or her shoulder 42 by means of the cushioning pad 40. The fire fighter then engages one of the releasable snap fasteners 52 on the hip beneath the arm 64 with the radially projecting loop 18 of another one of the padeyes 14 projecting through the rearmost reinforcing band 24, as shown in FIG. 1.

A right handed fire fighter will normally utilize the releasable snap fastener 52 on his or her right hip, as illustrated in FIG. 1, while a left handed fire fighter will typically utilize the releasable snap fastener 52 on his or her left hip and carry the shoulder strap 28 over his or her left shoulder. The device of the invention may be utilized by either right handed or left handed fire fighters. No adjustment of the mechanisms is required to change from either right handed or left handed use.

As is evident from FIG. 1, the shoulder strap 28 and waist belt 50 together form a harness for carrying the nozzle end of the fire hose 12. The harness apparatus of the invention allows the fire fighter 10 to bear the weight of the hose 12 and to control the very large forces of the considerable jet of water emanating therefrom through back, shoulder and leg muscles, and not with the arm muscles alone. Furthermore, due to the connection of the hose 12 to the fire fighter's waist through the waist belt 50, the fire fighter 10 can twist and manipulate the direction of the nozzle 26 using the more powerful abdominal, chest and back muscles, rather than having to rely strictly upon the arm strength as in conventional fire fighting practice.

The fire fighting apparatus of the invention serves to greatly increase the control which a fire fighter 10 has over a fire hose 12. The apparatus of the invention also reduces the likelihood that the fire fighter 10 will lose control of the hose 12. The fire fighter 10 is thereby able to aid in knocking down and putting out a fire with less danger of loss of control of the hose, with less fatigue, and with greater safety than has heretofore been possible. The harness apparatus of the invention thereby greatly improves the efficiency of a fire fighter 10 in combatting fires.

Undoubtedly, numerous variations and modifications of the invention will become readily apparent to those familiar with fire fighting equipment. For example, the legs of the radially projecting loops 18 could be hinged to the pad 16 so as to fold down into a U-shaped recess in the reinforcing bands 22 and 24 to facilitate packing the hose 12 for storage. Other alternative constructions of the invention are also possible. Accordingly, the scope of the invention should not be construed as limited to this specific embodiment depicted and described.

I claim:

1. In combination, a tubular fire fighting hose having an inside diameter of at least one and one-half inches and a nozzle at one end thereof and a plurality of attachment devices arranged in longitudinally spaced sets proximate said nozzle, wherein each of said sets is firmly secured to said hose at a fixed, longitudinal distance from said nozzle, and wherein each of said sets is comprised of at least one loop projecting radially outwardly from said hose, a shoulder strap forming a shoulder sling for assistance in supporting said hose and having opposite ends with releasable snaps mounted on both of said opposite ends of said shoulder strap by swivels for releasably engaging said loops, and a waist belt having opposite belt ends attachable to each other and releasable connectors mounted by means of swivels at fixed positions on said waist belt at spaced intervals from both of said opposite belt ends, whereby said swivel mounted releasable snaps of said waist belt reside proximate the hips of a wearer and are also releasably connectable to said loops.

2. A combination according to claim 1 wherein each of said sets includes a plurality of said loops spaced from each other circumferentially about said hose, and said loops project radially outwardly from transverse pads embedded in the structure of said hose.

3. A combination according to claim 2 further comprising a reinforcing band disposed coaxially about said fire hose in longitudinal alignment with each of said sets of attachment devices, whereby said bands circumferentially reinforce said hose and entrap said pads of said attachment devices therewithin and define longitudinal slots through which said loops project.

4. In a fire fighting hose having a flexible tube formed with an inside diameter of at least one and one-half inches and with a nozzle at one end thereof, the improvement comprising a plurality of attachment devices each comprised of a pad eye having a loop which projects radially outwardly from a pad, and said attachment devices are further comprised of reinforcing bands extending about said tubular structure of said hose and are firmly secured to said hose at longitudinally separated locations along said flexible tube proximate to and at fixed distances from said nozzle, and said bands each have narrow slots defined therein through which said loops of said pad eyes project radially outwardly and said pads extend laterally beyond said slots whereby said bands entrap said pads within their radial confines, and further comprising a shoulder strap having opposite ends with releasable snaps mounted by swivels on said shoulder strap ends for releasable engagement with said loops of said pad eyes, wherein each of said shoulder strap ends is connected to a different one of said loops projecting from a different one of said bands at said longitudinally separated locations on said tube, and further comprising a waist belt having opposite belt ends releasably attachable to each other and releasable snaps are mounted by swivels that are firmly secured at fixed locations on said waist belt in spaced separation from the belt ends thereof and proximate a wearer's hips, whereby said snaps mounted on said waist belt are also releasably engagable with said loops of said pad eyes.

5. A fire hose according to claim 4 wherein said pad eyes are arranged in separate sets at each of said longitudinally separated locations and each set is comprised of a plurality of said pad eyes as aforesaid and said pad eyes within each of said sets are circumferentially spaced from each other within the confines of said reinforcing bands.

6. In combination a tubular fire fighting hose having an inside diameter of at least one and one-half inches and having a nozzle at one end thereof, a pair of sets of attachment means firmly secured at fixed locations on said hose proximate said nozzle and in longitudinally spaced separation from each other, wherein each of said attachment means is comprised of at least one loop that is secured to said hose and projects radially outwardly therefrom, and a shoulder strap having opposite ends with releasable snap connectors on each of said ends of said shoulder strap for releasable coupling to said loops, and a swivel connection between each of said releasable snap connectors and said ends of said shoulder strap wherein each of said shoulder strap ends is coupled to a loop in a different one of said sets of attachment means, and a waist belt having releasable snap connectors mounted by swivels at fixed locations thereon proximate a wearer's hips for releasable coupling to said loops whereby said releasable snap connectors of said shoulder strap and said waist belt are all releasably engageable with said loops of said attachment means.

7. A combination according to claim 6 further comprising a plurality of loops in each of said sets and said loops in each of said sets are disposed at circumferentially spaced intervals about said fire fighting hose.

8. A combination according to claim 7 further comprising reinforcing bands disposed about each of said sets of attachment means and said loops of said attachment means project through said reinforcing bands and are thereby accessible for coupling to said ends of releasable snap connectors on said shoulder strap and to said releasable snap connectors on said waist belt.

9. A combination according to claim 8 wherein said attachment means include pad eyes anchored to said reinforcing bands and from which said loops project radially outwardly.

* * * * *